US007483831B2

(12) United States Patent
Rankovic

(10) Patent No.: US 7,483,831 B2
(45) Date of Patent: Jan. 27, 2009

(54) METHODS AND APPARATUS FOR MAXIMIZING SPEECH INTELLIGIBILITY IN QUIET OR NOISY BACKGROUNDS

(75) Inventor: Christine M. Rankovic, Newton, MA (US)

(73) Assignee: Articulation Incorporated, Cambridge, MA (US)

( * ) Notice: Subject to any disclaimer, the term of this patent is extended or adjusted under 35 U.S.C. 154(b) by 906 days.

(21) Appl. No.: 10/719,577

(22) Filed: Nov. 21, 2003

(65) Prior Publication Data

US 2005/0114127 A1 May 26, 2005

(51) Int. Cl.
*G10L 21/02* (2006.01)

(52) U.S. Cl. ..... 704/225; 704/226

(58) Field of Classification Search ..... 704/225, 704/226; 381/94.1–94.3, 106, 107; 455/72
See application file for complete search history.

(56) References Cited

U.S. PATENT DOCUMENTS 4,887,299 A * 12/1989 Cummins et al. ..... 381/317
5,027,410 A * 6/1991 Williamson et al. ..... 381/320
5,794,188 A * 8/1998 Hollier ..... 704/228
5,848,384 A * 12/1998 Hollier et al. ..... 704/231
6,304,634 B1 * 10/2001 Hollier et al. ..... 379/22.02

OTHER PUBLICATIONS

ANSI S3.5-1997. Methods for calculation of the speech intelligibility index. American Nation Standards Institute, Inc., New York, NY. (34 pages).

Fletcher, H. (1954). Hearing aid design for selective fitting. Audecibel 3:6 (Nov./Dec.), pp. 11-13, 15.

Fletcher, H. (1952). The perception of speech sounds by deafened persons. Journal of the Acoustical Society of America 24, pp. 490-497.

Fletcher, H. and Galt, R.H. (1950). The perception of speech and its relation to telephony. Journal of the Acoustical Society of America 22, pp. 89-151.

Ludvigsen, C. (1985). Relations among some psychoacoustic parameters in normal and cochlearly impaired listeners. Journal of the Acoustical Society of America 78, pp. 1271-1280.

Moore, B.C.J. and Glasberg, B.R. (1997). A model of loudness perception applied to cochlear hearing loss. Auditory Neuroscience 3, pp. 289-311.

(Continued)

*Primary Examiner*—Michael N Opsasnick
(74) *Attorney, Agent, or Firm*—Nutter McClennen & Fish LLP; David J. Powsner

(57) ABSTRACT

Methods and apparatus for maximizing speech intelligibility use psycho-acoustic variables of a model of speech perception to control the determination of optimal frequency-band specific gain adjustments. Speech signals (or other audio input) whose intelligibility is to be improved are characterized by parameters which are applied to the model. These include measurements or estimates of speech intensity level, average noise spectrum of the incoming audio signal, and/or the current frequency-gain characteristic of the hearing compensation device. Characterizations of listeners based on hearing test results, for example, may also be applied to the model. Frequency-band specific gain adjustments generated by use of the model can be used for hearing aids, assistive listening devices, telephones, cellular telephones, or other speech delivery systems, personal music delivery systems, public-address systems, sound systems, speech generating systems, or other devices or mediums which project, transfer or assist in the detection or recognition of speech.

35 Claims, 3 Drawing Sheets

OTHER PUBLICATIONS

Rankovic, C.M. (1997). Prediction of speech reception for listeners with sensorineural hearing loss. In W. Jesteadt (ed.) Modeling Sensorineural Hearing Loss, pp. 421-431, Lawrence Erlbaum Associates, Mahwah, NJ.

Rankovic, C.M., Freyman, R.L., and Zurek, P.M. (1992). Potential benefits of adaptive frequency-gain characteristics for speech reception in noise. Journal of the Acoustical Society of America 91, pp. 354-362.

* cited by examiner

METHODS AND APPARATUS FOR MAXIMIZING SPEECH INTELLIGIBILITY IN QUIET OR NOISY BACKGROUNDS

BACKGROUND OF THE INVENTION

The invention pertains to speech signal processing and, more particularly, to methods and apparatus for maximizing speech intelligibility in quiet or noisy backgrounds. The invention has applicability, for example, in hearing aids and cochlear implants, assistive listening devices, personal music delivery systems, public-address systems, telephony, speech delivery systems, speech generating systems, or other devices or mediums that produce, project, transfer or assist in the detection, transmission, or recognition of speech.

Hearing and, more specifically, the reception of speech involves complex physical, physiological and cognitive processes. Typically, speech sound pressure waves, generated by the action of the speaker's vocal tract, travel through air to the listener's ear. En route, the waves may be converted to and from electrical, optical or other signals, e.g., by microphones, transmitters and receivers that facilitate their storage and/or transmission. At the ear, sound waves impinge on the eardrum to effect sympathetic vibrations. The vibrations are carried by several small bones to a fluid-filled chamber called the cochlea. In the cochlea, the wave action induces motion of the ribbon-like basilar membrane whose mechanical properties are such that the wave is broken into a spectrum of component frequencies. Certain sensory hair cells on the basilar membrane, known as outer hair cells, have a motor function that actively sharpens the patterns of basilar membrane motion to increase sensitivity and resolution. Other sensory cells, called inner hair cells, convert the enhanced spectral patterns into electrical impulses that are then carried by nerves to the brain. At the brain, the voices of individual talkers and the words they carry are distinguished from one another and from interfering sounds.

The mechanisms of speech transmission and recognition are such that background noise, irregular or limiting frequency responses, reverberation and/or other distortions may garble transmission, rendering speech partially or completely unintelligible. A fact well known to those familiar in the art is that these same distortions are even more ruinous for individuals with hearing impairment. Physiological damage to the eardrum or the bones of the middle ear acts to attenuate incoming sounds, much like an earplug, but this type of damage is usually repairable with surgery. Damage to the cochlea caused by aging, noise exposure, toxicity or various disease processes is not repairable. Cochlear damage not only impedes sound detection, but also smears the sound spectrally and temporally, which makes speech less distinct and increases the masking effectiveness of background noise interference.

The first significant effort to understand the impact of various distortions on speech reception was made by Fletcher who served as director of the acoustics research group at AT&T's Western Electric Research (renamed Bell Telephone Laboratories in 1925) from 1916 to 1948. Fletcher developed a metric called the articulation index, AI, which is " . . . a quantitative measure of the merit of the system for transmitting the speech sound." Fletcher and Galt, infra, at p. 95. The AI calculation requires as input a simple acoustical description of the listening condition (i.e. speech intensity level, noise spectrum, frequency-gain characteristic) and yields the AI metric, a number that ranges from 0 to 1, whose value predicts performance on speech intelligibility tests. The AI metric first appeared in a 1921 internal report as part of the telephone company's effort to improve the clarity of telephone speech. A finely tuned version of the calculation, upon which the present invention springboards, was published in 1950, nearly three decades later.

Simplified versions of the AI calculation (e.g. ANSI S3.5-1969, 1997) have been used to test the capacity of various devices for transmitting intelligible speech. These versions originate from an easy-to-use AI calculation provided by Fletcher' staff to the military to improve aircraft communication during the World War II war effort. Those familiar with the art are aware that simplified AI metrics rank communication systems that differ grossly in acoustical terms, but they are insensitive to smaller but significant differences. They also fail in comparisons of different distortion types (e.g., speech in noise versus filtered speech) and in cases of hearing impairment. Although Fletcher's 1950 finely tuned AI metric is superior, those familiar with the art dismiss it, presumably, because it features concepts that are difficult and at odds with current research trends. Nevertheless, as discovered by the inventor hereof and evident in the discussion that follows, these concepts taken together with the prediction power of the AI metric have proven fertile ground for the development of signal processing methods and apparatus that maximize speech intelligibility.

SUMMARY OF THE INVENTION

The above objects are among those attained by the invention which provides methods and apparatus for enhancing speech intelligibility that use psycho-acoustic variables, from a model of speech perception such as Fletcher's AI calculation, to control the determination of optimal frequency-band specific gain adjustments.

Thus, for example, in one aspect the invention provides a method of enhancing the intelligibility of speech contained in an audio signal perceived by a listener via a communications path which includes a loud speaker, hearing aid or other potential intelligibility enhancing device having an adjustable gain. The method includes generating a candidate frequency-wise gain which, if applied to the intelligibility enhancing device, would maximize an intelligibility metric of the communications path as a whole, where the intelligibility metric is a function of the relation:

$$AI=V\times E\times F\times H$$

where, AI is the intelligibility metric; V is a measure of audibility of the speech contained in the audio signal and is associated with a speech-to-noise ratio in the audio signal; E is a loudness limit associated the speech contained in the audio signal; F is a measure of spectral balance of the speech contained in the audio signal; and H is a measure of any of (i) intermodulation distortion introduced by an ear of the subject, (ii) reverberation in the medium, (iii) frequency-compression in the communications path, (iv) frequency-shifting in the communications path and (v) peak-clipping in the communications path, (vi) amplitude compression in the communications path, (vii) any other noise or distortion in the communications path not otherwise associated with V, E and F.

Related aspects of the invention provide a method as described above including the step of adjusting the gain of the aforementioned device in accord with the candidate frequency-wise gain and, thereby, enhancing the intelligibility of speech perceived by the listener.

Further aspects of the invention provide generating a current candidate frequency-wise gain through an iterative approach, e.g., as a function of a broadband gain adjustment and/or a frequency-wise gain adjustment of a prior candidate frequency-wise gain. This can include, for example, a noise-minimizing frequency-wise gain adjustment step in which the candidate frequency-wise gain is adjusted to compensate for a noise spectrum associated with the communications path—specifically; such that adjustment of the gain of the intelligibility enhancing device in accord with that candidate frequency-wise gain would bring that spectrum to audiogram thresholds. This can include, by way of further example, re-adjusting the current candidate frequency-wise gain to remove at least some of the adjustments made in noise-minimizing frequency-wise gain adjustment step, e.g., where that readjustment would result in further improvements in the intelligibility metric, AI. Related aspects of the invention provide methods as described above in which the current candidate frequency-wise gain is generated in so as not to exceed the loudness limit, E.

Other related aspects of the invention provide methods as described above in which the candidate frequency-wise gain associated with the best or highest intelligibility metric is selected from among the current candidate frequency-wise gain and one or more prior candidate frequency-wise gains. A related aspect of the invention provides for selecting a candidate frequency-wise gain as between a current candidate frequency-wise gain and a zero gain, again, depending on which of is associated the highest intelligibility metric.

Further aspects of the invention provide methods as described above in which the step of generating a current candidate frequency-wise gain is executed multiple times and in which a candidate frequency-wise gain having the highest intelligibility metric is selected from among the frequency-wise gains so generated.

In still another aspect, the invention provides a method of enhancing the intelligibility of speech contained in an audio signal that is perceived by a listener via a communications path. The method includes generating a candidate frequency-wise gain that mirrors an attenuation-modeled component of an audiogram for the listener, such that a sum of that candidate frequency-wise gain and that attenuation-modeled component is substantially zero; adjusting the broadband gain of the candidate frequency-wise gain so that, if applied to an intelligibility enhancing device in the transmission path, would maximize an intelligibility metric of the communications path without substantially exceeding a loudness limit, E, for the subject, where the intelligibility metric is a function of the foregoing relation $AI=V\times E\times F\times H$; adjusting the frequency-wise gain to compensate for a noise spectrum associated with the communications path, specifically, such that adjustment of the gain of the intelligibility enhancing device in accord with that candidate frequency-wise gain would bring that spectrum to audiogram thresholds; adjusting the broadband gain of the candidate frequency-wise gain so that, if applied to the intelligibility enhancing device, would maximize an intelligibility metric of the communications path without substantially exceeding a loudness limit, E, for the subject; testing whether adjusting the candidate frequency-wise gain to remove at least some of the adjustments would increase the intelligibility metric of the communications path and, if so, adjusting the candidate frequency-wise gain; adjusting the broadband gain of the candidate frequency-wise gain so that, if applied to the intelligibility enhancing device, would maximize an intelligibility metric of the communications path without substantially exceeding a loudness limit, E, for the listener; choosing the candidate frequency-wise gain characteristic associated the highest intelligibility metric; adjusting the gain of the hearing compensation device in accord with the candidate frequency-wise gain characteristic so chosen.

Further aspects of the invention provide methods as described above in which the intelligibility enhancing device is a hearing aid, assistive listening device, cellular telephone, personal music delivery system, voice over internet protocol telephony system, public-address systems, or other devices or communications paths.

Related aspects of the invention provide intelligibility enhancing devices operating in accord with the methods described above, e.g., to generate candidate frequency-wise gains to apply those gains for purposes of enhancing the intelligibility of speech perceived by the listener via communications paths which include those devices.

These and other aspects of the invention are evident in the drawings and in the discussion that follows.

BRIEF DESCRIPTION OF THE DRAWINGS

A more complete understanding of the invention may be attained by reference to the drawings in which.

DETAILED DESCRIPTION OF THE ILLUSTRATED EMBODIMENT

Overview

Figure 1:
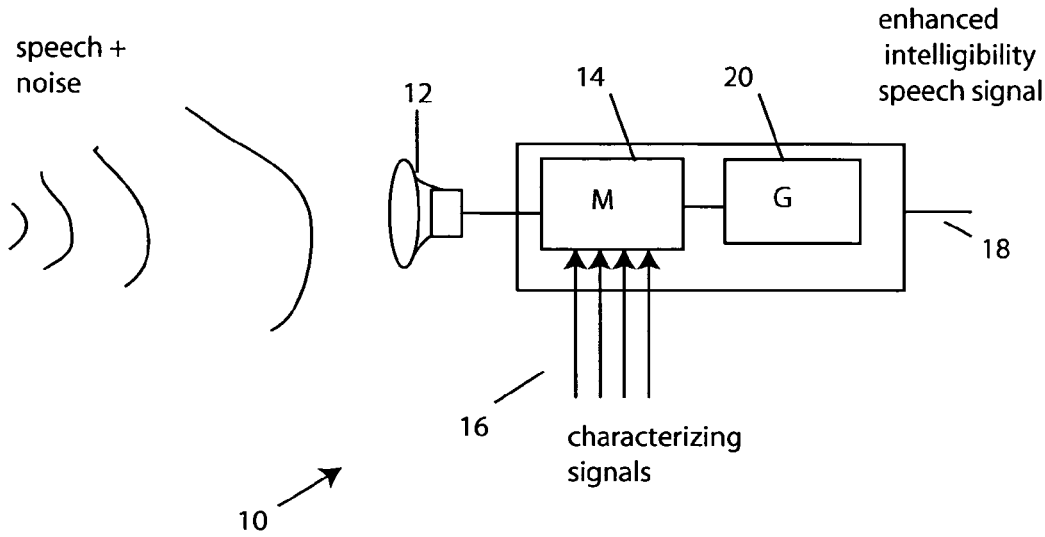
FIG. 1, which depicts a hearing compensation device according to the invention.

FIG. 1 depicts a intelligibility enhancing device 10 according to one practice of the invention. This can be a hearing aid, assistive listening device, telephone or other speech deliver system (e.g., a computer telephony system, by way of non-limiting example), mobile telephone, personal music delivery system, public-address system, sound system, speech generating system (e.g., speech synthesis system, by way of non-limiting example), or other audio devices that can be incorporated into the communications path of speech to a listener, including the speech source itself. In this regard, the listener is typically a human subject though the "listener" may comprise multiple subjects (e.g., as in the case of intelligibility enhancement via a public address system), one or more non-human subjects (e.g., dogs, dolphins or other creatures), or even inanimate subjects, such as (by way of non-limiting example) computer-based speech recognition programs. The device 10 includes a sensor 12, such as a microphone or other device, e.g., that generates an electric signal (digital, analog or otherwise) that includes a speech signal—here, depicted as a speech-plus-noise signal to reflect that it includes both speech and noise components—the intelligibility of which is to be enhanced. The sensor 12 can be of the conventional variety used in hearing aids, assistive listening devices, telephones or other speech delivery systems, mobile telephones, personal music delivery systems, public-address systems, sound systems, speech generating systems, or other audio devices. It can be coupled to amplification circuitry, noise cancellation circuitry, filter or other post-sensing circuitry (not shown) also of the variety conventional in the art.

The speech-plus-noise signal, as so input and/or processed, is hereafter referred to as the incoming audio signal. The speech portion can represent human-generated speech, artificially-generated speech, or otherwise. It can be attenuated, amplified or otherwise affected by a medium (not shown) via which it is transferred before reaching the sensor and, indeed, further attenuated, amplified or otherwise affected by the sensor 12 and/or any post-sensing circuitry through which it passes before processing by a element 14. Moreover, it can include noise, e.g., generated by the speech source (not shown), by the medium through which it is transferred before reaching the sensor, by the sensor and/or by the post-sensing circuitry.

Element 14 determines an intelligibility metric for the incoming audio signal. This is based on a model, described below, whose operation is informed by parameters 16 which include one or more of: measurements, estimates, or default values of speech intensity level in the incoming audio signal, measurements, estimates, or default values of average noise spectrum of the incoming audio signal, and/or measurements, estimates, or default values of the current frequency-gain characteristic of the intelligibility enhancing device. The parameters can also include a characterization of the listener (or listeners)—e.g., those person or things which are expected recipients of the enhanced-intelligibility speech signal 18—based on audiogram estimates, default values or test results, for example, or if one or more of them (listener or listeners) are potentially subject to hearing loss. Element 14 can be implemented in special-purpose hardware, a general purpose computer, or otherwise, programmed and/or otherwise operating in accord with the teachings below.

The intelligibility metric, referred to below as AI, is optimized by a series of iterative manipulations, performed by 20, of a candidate frequency-wise characteristic that are specifically designed to maximize factors that comprise the AI calculation. The AI metric, 14, is calculated after certain manipulations to determine whether the action taken was successful—that is, whether the AI of speech transmitted through device 10 would indeed be maximized. The manipulations are negated if the AI would not increase. The candidate frequency-wise gain that results after the entire series of iterative manipulations has been attempted is the characteristic expected to maximize speech intelligibility, and is hereafter referred to as the Max AI characteristic, because it is optimizes the AI metric. Element 20 can be implemented in special-purpose hardware, a general purpose computer, or otherwise, programmed and/or otherwise operating in accord with the teachings below. Moreover, elements 14 and 20 can be embodied in a common module (software and/or hardware) or otherwise. Moreover, that module can be co-housed with sensor 12, or otherwise.

The Max AI frequency-wise gain is then applied to the incoming audio signal, via a gain adjustment control (not shown) of device 10 in order to enhance its intelligibility. The gain-adjusted signal 18 is then transmitted to the listener. In cases where the device 10 is a hearing aid or assistive listening device, such transmission may be via an amplified sound signal generated from the gain-adjusted signal for application to the listener's eardrum, via bone conduction or otherwise. In cases where the device 10 is a telephone, mobile telephone, personal music delivery system, such transmission may be via an earphone, speaker or otherwise. In cases where the device 10 is a speaker or public address system, such transmission may be earphone or further sound systems or otherwise.

Articulation Index

AI Metric

Illustrated element 14 generates an AI metric, the maximization of which is the goal of element 20. Element 20 uses that index, as generated by element 14, to test whether certain of a series of frequency-wise gain adjustments would increase the AI if applied to the input audio signal.

The articulation index calculation takes a simple acoustical description of the intelligibility enhancing device and the medium and produces a number, AI, which has a known relationship with scores on speech intelligibility tests. Therefore, the AI can predict the intelligibility of speech transmitted over the device. The AI metric serves as a rating of the fidelity of the sound system for transmitting speech sounds.

The acoustical measurements required as input to the AI calculation characterize all transformations and distortions imposed on the speech signal along the communications path between (and including) the talker's vocal cords (or other source of speech) and the listener's (or listeners') ear(s), inclusive. These transformations include the frequency-gain characteristic, the average spectrum of interfering noise contributed by all external sources, and the overall sound pressure level of the speech. For calibration purposes, the reference for all measurements is orthotelephonic gain, a condition defined as typical for communication over a 1-meter air path. The AI calculation readily accommodates additive noise and linear filtering and can be extended to accommodate reverberation, amplitude and frequency compression, and other distortions.

AI Equation

The AI metric is calculated as described by Fletcher, H. and Galt, R. H., "The perception of speech and its relation to telephony." J. Acoust. Soc. Am. 22, 89-151 (1950). The general equation is:

$$AI=V\times E\times F\times H$$

The four factors, V, E, F and H, take on values ranging from 0 to 1.0, where 0.0 indicates no contribution and 1.0 is optimal for speech intelligibility. They are calculated using the Fletcher's chart method, which requires as input the composite noise spectrum (from all sources), the composite frequency-gain characteristic, and the speech intensity level. Each factor is tied to an attribute of the input audio signal and can be viewed as the perceptual correlate of that attribute. The factor V is associated with the speech-to-noise ratio and is perceived as audibility of speech. Speech is inaudible when V is 0.0 and speech is maximally audible when V is 1.0. E is associated with the intensity level produced when speech is louder than normal conversation. Speech may be too loud when E is less than 1.0. F is associated with the frequency response shape and is perceived as balance. F is equal to 1.0 when the frequency-gain characteristic is flat and may decrease with sloping or irregular frequency responses. H is associated with the percept of noisiness introduced by intermodulation distortion and/or other distortions not accounted for by V, E or F. For intermodulation distortion, H equals 1.0 when there is no noise and decreases when speech peak and noise levels are both high and of similar intensity. Fletcher provides unique definitions of H for other distortions.

The AI metric is the result of multiplying the four values together. An AI near or equal to 1.0 is associated with highly intelligible speech that is easy to listen to and clear. An AI equal to zero means that speech is not detectable.

Maximizing the AI

Using the methodology discussed below, element 20 adjusts frequency-specific and broadband gain according to rules that maximize the variables F and V, while ensuring that the variable E remains near 1.0. Then, the broadband gain is adjusted again in an attempt to maximize the variable H, but still limited by E. When external noise is present, frequency regions having significant noise are attenuated by amounts that reduce the noise interference to the extent possible. The goals are to reduce the spread of masking of the noise onto speech in neighboring frequency regions (particularly, upward spread) and reduce any intermodulation distortion generated by the interaction of frequency components of the speech with those of noise, of noise with itself, or of speech with itself. AI's are calculated and tracked to make sure that the noise suppression is not canceled by other manipulations unless the manipulations increase the AI.

The methodology utilized by element 20 compares the AI calculated after certain adjustments of the candidate frequency-wise gain with AI's of previous candidate frequency-wise gains and with the AI of the original incoming audio signal in order to ascertain improvement. Conceptually, the methodology optimizes the spectral placement of speech within the residual dynamic speech range by minimizing the impact of the noise and ear-generated distortions. Thus, it will be appreciated that the AI-maximizing frequency-gain characteristic is found by means of a search consisting of sequence of steps intended to maximize each variable of the AI equation. Manipulations may increase the value of one factor but decrease the value of another; therefore tradeoffs are assessed and resolved.

Fletcher's AI calculation did not include certain transformations necessary to accommodate noise input and hearing loss. Transformations are necessary to determine the amount of masking caused by a noise because the masking is not directly related to the noise's spectrum. Masking increases nonlinearly with noise intensity level so that the extent of masking may greatly exceed any increase in noise intensity. This effect is magnified for listeners with cochlear hearing loss due to the loss of sensory hair cells that carry out the ear's spectral enhancement processing. These transformations can be made via any of several methods published in the scientific literature on hearing (Ludvigsen, "Relations among some psychoacoustic parameters in normal and cochlearly impaired listeners" J. Acoust. Soc. Am., vol. 78, 1271-1280 (1985)).

Audiogram Interpretation and Hearing Loss Modeling

Hearing loss is defined by conventional clinical rules for interpreting hearing tests that measure detection thresholds for sinusoidal signals, referred to as pure tones, at frequencies deemed important for speech recognition by those familiar in the art. Element 14 employs methods for interpreting hearing loss as if a normal-hearing listener were in the presence of an amount of distortion sufficient to simulate the hearing loss. Simulation is necessary for incorporating the hearing loss into the AI calculation without altering the calculation. The hearing loss is modeled as a combination of two types of distortion: (1) a fictitious noise whose spectrum is deduced from the hearing test results using certain psycho-acoustical constants; and (2) an amount of frequency-specific attenuation comprising the amount of the hearing loss not accounted for by the fictitious noise. The fictitious noise spectrum is combined with any externally introduced noise, and the attenuation is combined with the device frequency-gain characteristic and any other frequency-gain characteristic that has affected the input. Then, the AI calculation proceeds as if the listener had normal hearing, but was listening in the corrected noise filtered by the corrected frequency-gain characteristic.

In order to model the hearing loss, it is first necessary to classify the hearing loss as conductive, sensorineural or as a mixture of the two (see Background section above). Conductive hearing loss impedes transmission of the sound; therefore, the impact of conductive hearing loss is to attenuate the sound. The precise amount of attenuation as a function of frequency is determined from audiological testing, by subtracting thresholds for pure-tones presented via bone conduction from those presented via air conduction. If there is no significant difference between bone and air conduction thresholds, then the hearing loss is interpreted as sensorineural. If there is a significant difference and the bone conduction thresholds are significantly poorer than average normal, then the hearing loss is mixed, meaning there are both sensorineural and conductive components.

Sensorineural hearing loss is typically attributed to cochlear damage. All or part of sensorineural hearing loss can be interpreted as owing to the presence of a fictitious noise whose spectrum is deduced from the listener's audiogram. This is referred to by those in the art as modeling the hearing loss as noise. The spectrum of such a noise is found by subtracting, from each pure-tone threshold on the audiogram, the bandwidth of the auditory filter at that frequency. The auditory filter bandwidths are known to those familiar in the art of audiology. In some interpretations, only a portion of the total sensorineural hearing loss is modeled accurately as a noise. The remaining hearing loss is modeled better as attenuation. The proportions attributed to noise or attenuation are prescribed by rules derived from physiological or psychoacoustical research or are otherwise prescribed.

Element 14 accepts hearing test results and models hearing loss as attenuation in the case of a conductive hearing loss, and as a combination of attenuation and noise in the case of sensorineural hearing loss.

Operation

Figure 2:
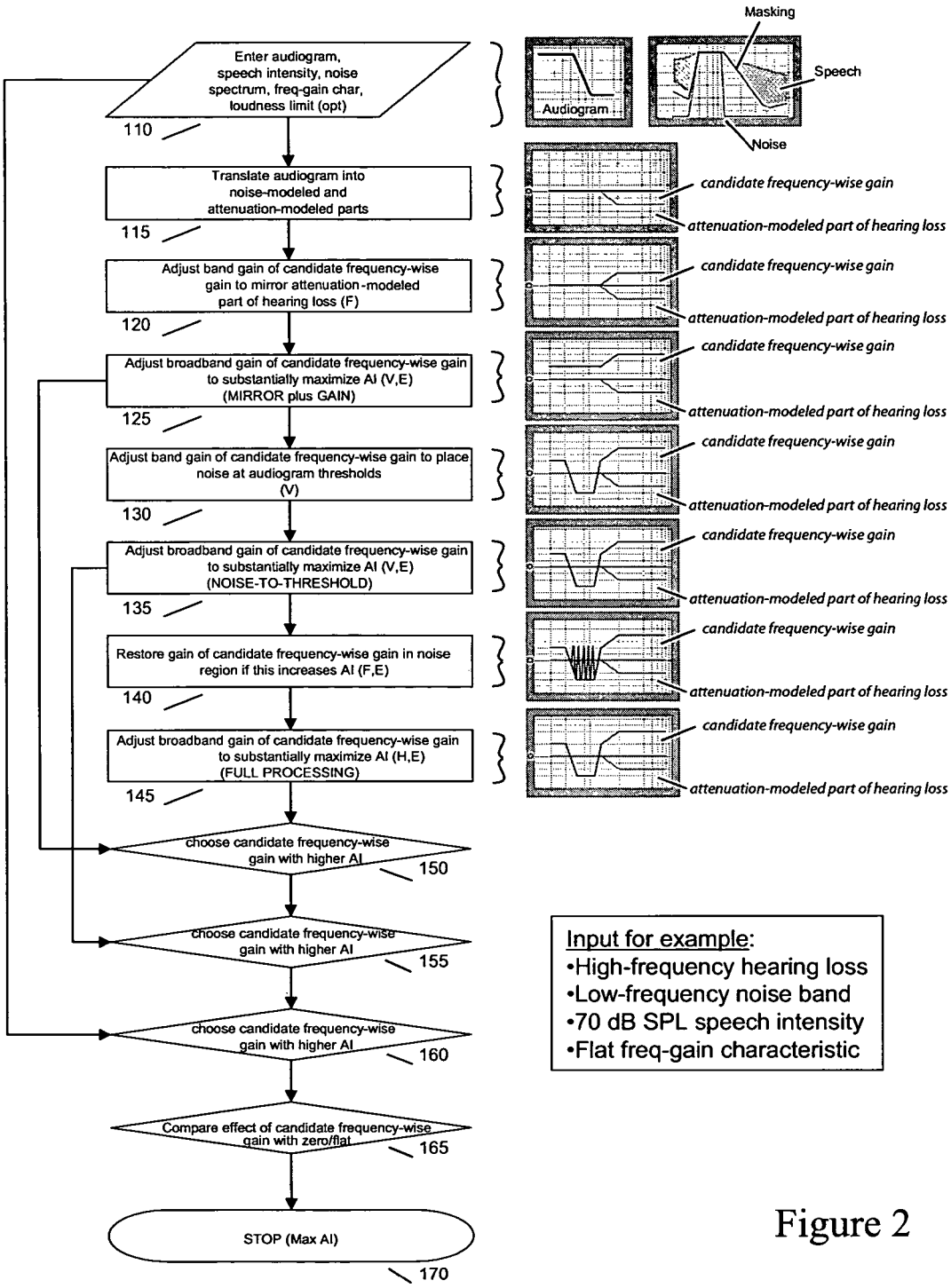
FIG. 2 is a flow chart depicting operation of, and processing by, an intelligibility enhancing device or system according to the invention.

Operation of the device 10 is discussed below with reference to the flowchart and graphs of FIG. 2 and the block diagram of FIG. 3.

Definitions of Input Parameters (1) Audiogram; (2) Speech Intensity Level; (3) Noise Spectrum, and (4) Maximum Tolerable Loudness In step 110, element 16 of the illustrated embodiment accepts audiogram, speech intensity, noise spectrum, frequency response and loudness limit information, as summarized above and detailed below (see the Hearing Loss Input and Signal Input elements of FIG. 3). It will be other embodiments may vary in regard to the type of information entered in step 110.

Audiogram (dB HL). (See the Hearing Loss Input element of FIG. 3). The audiogram is a measure of the intensity level of the just detectable tones, in dB HL (Hearing Level in decibels), at each of a number of test frequencies, as determined by a standardized behavioral test protocol that measures hearing acuity. Typically, a trained professional controls the presentation of calibrated pure-tone signals with an audiometer, and records the intensity level of tones that are just detectable by the listener. The deviation of the listener's thresholds from 0 dB HL (normal-hearing) gives the amount of hearing loss (in dB). Shown adjacent the box labeled 110 is a graphical representation, or plot, comprising a conventional audiogram. Systems according to the invention can accept digital representations of audiograms or operator input characterizing key features of graphical representations.

Although the invention is not so limited, audiometric test frequencies typically include:

Air conduction (earphone test)

Required 0.25, 0.5, 1, 2, 4, and 8 kHz

Optional 0.125, 0.75, 1.5, 3, and 6 kHz

Bone conduction (bone vibrator test)

Required 0.25, 0.5, 1, 2, 4 kHz

Optional 0.75, 1.5, 3 kHz

The lower intensity limit of a typical audiometer is −10 dB HL at all frequencies.

The hearing test involves increasing and decreasing a tone's intensity in 5-dB increments to bracket the tone detection threshold. Therefore, threshold values are multiples of five.

Typical upper intensity limits of an audiometer are: 105 dB HL for 0.125 and 0.25 kHz; 120 dB HL for 0.5 through 4 kHz; 115 dB HL for 6 kHz; and 110 dB HL for 8 kHz.

Systems according to the invention can accommodate non-standard hearing test procedures, e.g., if the calibration is provided or can be deduced from a description of the test.

Average speech sound pressure level (dB SPL). The speech intensity and the noise spectrum are estimated (see the Speech/Noise Separator of FIG. 3) from the signal input (see the Signal Input element of FIG. 3) using methods not specified here. In the illustrated embodiment, the average overall intensity level of the speech signal is specified in dB SPL (sound pressure level in dB re 0.0002 dynes/cm2). Average conversational speech is 68 dB SPL when a typical talker is one meter from the measuring microphone. The duration for averaging should be reasonable.

Average noise spectrum (PSD dB SPL). In the illustrated embodiment, the average noise spectrum is specified as mean power spectral density (PSD) in dB SPL over frequencies spanning the range from 200 to 8000 Hz. A representation of this is presented in the second graph adjacent the box labeled 110.

Maximum tolerable speech sound pressure level (dB SPL). The maximum tolerable speech level is the maximum speech level that the listener indicates is tolerable for a long period. The signal used for testing this may be broadband, unprocessed speech presented without background noise. The behavioral test used for obtaining this value is not specified.

Calibration. Calibration corrections are applied to hearing test (audiogram) and acoustic measurements (speech, noise, frequency-gain characteristics) so that the corrected values refer to the orthotelephonic reference condition. That is, input measurements are corrected to values that would have been measured had the measuring taken place in a sound field with the measuring microphone located at the center of an imaginary axis drawn between the listener's ears, with the listener absent from the sound field. In the illustrated embodiment, these corrections are deduced from published ANSI and ISO standards, e.g., ANSI S3.6-1996, "American National Standard specification for audiometers" (American National Standards Institute, New York) and ISO 389-7:1996. Acoustics—Reference zero for the calibration of audiometric equipment; Part 7: Reference threshold of hearing under free-field and diffuse-field listening conditions. International Organization for Standardization, Geneva, Switzerland.

Audiogram preprocessor

If hearing is normal, this is not an issue.

In the illustrated embodiment, the air-bone gap (air conduction thresholds minus bone conduction thresholds) is calculated at 0.25, 0.5, 1, 2, and 4 kHz; other embodiments may vary.

At each frequency, an air-bone gap greater than 10 dB indicates a conductive component to the hearing loss; otherwise hearing loss is sensorineural.

If bone conduction thresholds are less than 15 dB HL at more than three of the five frequencies, then the hearing loss is purely conductive. Otherwise, the hearing loss is "mixed" (having both conductive and sensorineural components)

If the hearing loss is mixed, the sensorineural part is represented by the bone conduction thresholds, and the air-bone gap represents the conductive component In the illustrated embodiment, the noise-modeled part of hearing loss can be converted to PSD dB SPL by subtracting auditory filter bandwidths per Fletcher. These values are then interpolated to the 20 frequencies: 0.2, 0.3, 0.4, 0.5, 0.6, 0.7, 0.8, 0.9, 1, 1.25, 1.5, 1.75, 2, 2.5, 3, 4, 5, 6, 7, and 8 kHz. Other embodiments may vary in this regard.

Hearing Loss Modeling

Figure 3:
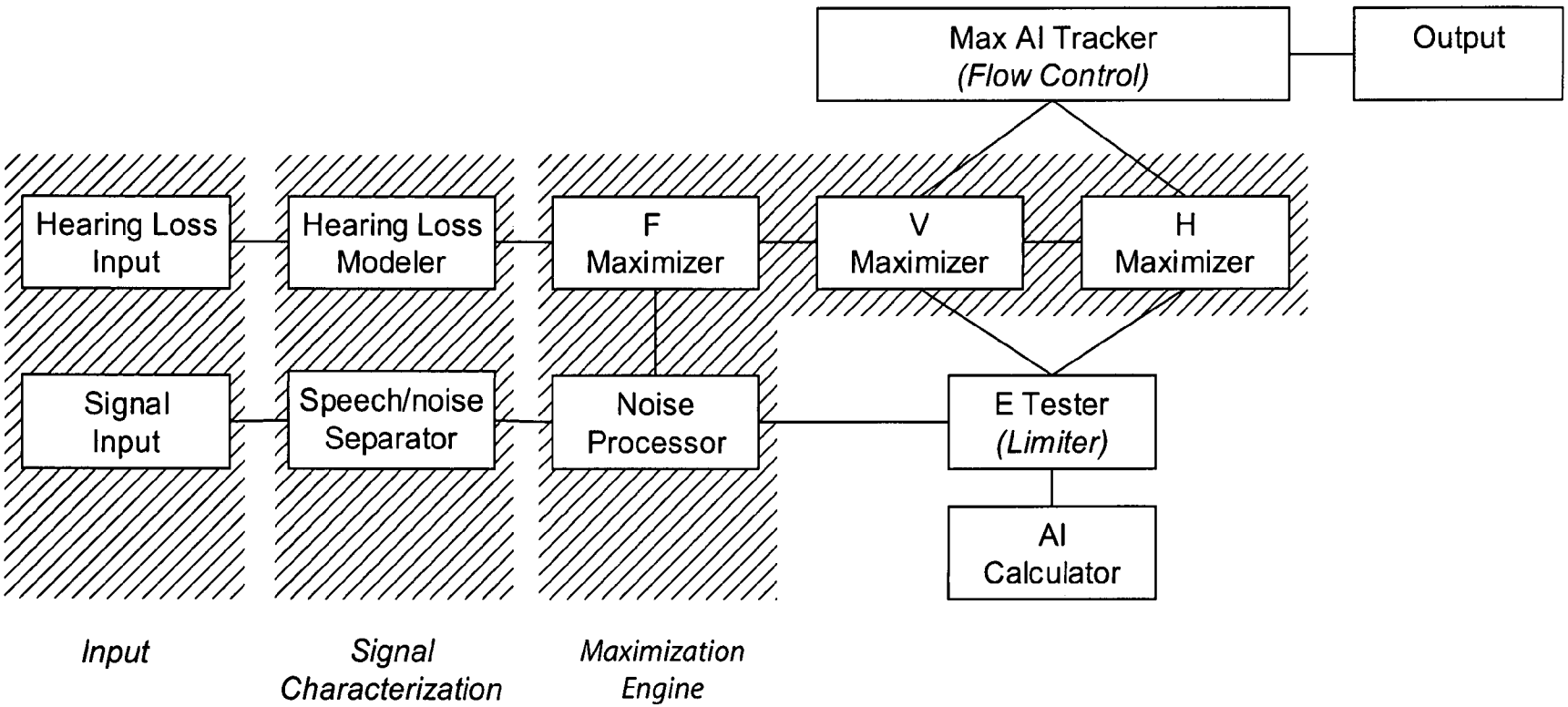
FIG. 3 is a block diagram of an intelligibility enhancing device or system according to the invention.

In step 115, element 14 translates the audiogram into noise-modeled and attenuation-modeled parts, e.g., as represented in the graph adjacent the box labeled 115 (see the Hearing Loss Modeler element of FIG. 3).

Normal hearing is assumed unless otherwise indicated by the audiogram

Any conductive component is modeled as attenuation.

Sensorineural hearing loss is modeled as a combination of attenuation and noise. Moore, B. C. J. and Glasberg, B. R. (1997). "A model of loudness perception applied to cochlear hearing loss." Auditory Neurosci. 3, 289-311 ("Moore et al") suggest one approach for determining the amounts: For sensorineural hearing losses ranging from 0 dB HL up to and including 55 dB HL, 80% of the hearing loss (in dB) is modeled as noise and 20% as attenuation. Any amount of sensorineural hearing loss in excess of 55 dB is modeled as attenuation.

The total attenuation-modeled part of the hearing loss is the attenuation-modeled portion of the sensorineural hearing loss plus the conductive loss.

The noise-modeled component of the hearing loss is treated as a fixed noise floor. Immediately prior to calculating the AI, the higher value of either the masking caused by the processed external noise or the noise-modeled component of the hearing loss is taken to form a single noise spectrum then submitted to the calculation.

Calculate AIStart (element 14) (see the AI Calculator element of FIG. 3)

Adjust Frequency-wise Gain to Compensate for Attenuation-Modeled Part of Hearing Loss to Substantially Maximize F (see the F Maximizer Element of FIG. 3)

In step 120, element 20 adjusts the band gain to mirror the attenuation-modeled part of hearing loss, e.g., as represented in the graph adjacent to the box labeled 120. This is accomplished by applying a frequency-wise gain in order to bring the sum of the attenuation component and the gain toward zero (and, preferably, to zero) and, thereby, to substantially maximize F.

Adjust overall gain to substantially maximize V Using E as an upper limit (see the V Maximizer and E Tester Elements of FIG. 3)

In step 125, element 20 adjusts the broadband gain to substantially maximize AI (MIRROR plus GAIN), e.g., as represented in the graph adjacent the box labeled 125. In the illustrated embodiment, this is accomplished by the following steps. In reviewing these steps, and similar maximizing steps in the sections that follow, those skilled in the art will appreciate that the illustrated embodiment does not necessarily find the absolute maximum of AI in each instance (though that would be preferred) but, rather, finds a highest value of AI given the increments chosen and/or the methodology used.

Increment broadband gain (e.g., by 5 dB, or otherwise)

Calculate AI (element 14)

If AI>=AI from previous calculation (see the Max AI Tracker element of FIG. 3), and E>=E tolerance (see the E Tester element of FIG. 3), then repeat from "Increment broadband gain . . . "

Calculate AIMirror-plus-gain (element 14)

Save AI and frequency-wise gain

ADJUST FREQUENCY-WISE GAIN to ENACT NOISE REDUCTION (NOISE-TO-THRESHOLD) to INCREASE V by MINIMIZING UPWARD SPREAD of MASKING (see the Noise Processor Element of FIG. 3)

In step 130, element 20 adjusts band gain to place noise at audiogram thresholds, e.g., as represented in the graph adjacent the box labeled 130. In the illustrated embodiment, this is accomplished by the following steps:

In the illustrated embodiment, for each of 20 contiguous frequency bands (with center frequencies listed above), if noise is greater than an assumed default room noise, enact noise reduction as follows:

If the audiogram threshold is near normal, then attenuate the frequency band by the amount necessary to reduce the noise to audiogram threshold. This amount of attenuation (in dB) is referred to as the notch depth. The total amount of attenuation or gain applied to the frequency region at this point in the method is the notch value.

Practical limits for gain are −20 dB (an estimate of the maximum possible attenuation based on a closed earplug) to 55 dB (a high maximum gain for a hearing aid). Limit gain to this range.

Save notch depth and notch value for later use

If audiogram threshold is poorer than a normal hearing threshold,

If noise is above audiogram threshold, attenuate by an amount (dB) to position noise at threshold If noise is below audiogram threshold, amplify by an amount (dB) to position noise threshold Limit gain adjustment to the range −20 dB to 55 dB Save notch depth and notch value Calculate AI (element 14)

ADJUST BROADBAND GAIN to INCREASE V USING E as an UPPER LIMIT

In step 135, element 20 adjusts the broadband gain to substantially maximize AI (NOISE to THRESHOLD), e.g., as represented in the graph adjacent the box labeled 135. In the illustrated embodiment, this is accomplished via the following steps:

Increment broadband gain (e.g., by 5 dB, or otherwise)

In those frequency bands in which noise was attenuated to threshold in step 130, apply gain to achieve the notch value saved earlier. The goal is to restore the noise reduction enacted in step 130.

Limit range of gains to −20 dB to 55 dB

Calculate AI (element 14)

If AI>=AI from previous calculation, and E>=E tolerance, then repeat from "Increment broadband gain . . . "

Calculate AINoise-to-threshold (element 14)

Save AI and frequency-wise gain

ADJUST FREQUENCY-WISE GAIN to RESTORE ATTENUATION or AMPLICATION from STEP 130 to see if this INCREASES F (E is not a LIMIT HERE) (see the Noise Processor Element of FIG. 3)

In step 140, element 20 restores the band gain if this increases AI, e.g., as represented in the graph adjacent the box labeled 140. In the illustrated embodiment, it is accomplished by the following steps:

For each frequency band (starting with the 6-kHz band and then decreasing), replace the amount of gain that was added or subtracted in step 130. This amount was referred to above as the notch depth.

Limit gain adjustment to the range −20 to 55 dB

Calculate AI (element 14)

If new AI<previous AI

Fill in the notch 75%. For example, if step 130 resulted in 20 dB attenuation applied to the band of interest (i.e., the notch depth), then 75% of 20 would be 15 dB, so 15 dB would be added here), though other percentages and/or step sizes (greater or lesser) may be used.

Limit gain adjustment to the range −20 dB to 55 dB range

If new AI<previous AI, revert to condition that gave previous AI

Otherwise, save the condition as the new best AI

Repeat for fills of 50% and 25%

Calculate AI (element 14)

ADJUST OVERALL GAIN to INCREASE H USING E as an UPPER LIMIT (see the H Maximizer Element of FIG. 3)

In step 145, element 20 adjusts the broadband gain to substantially maximize AI (FULL PROCESSING), e.g., as represented in the graph adjacent the box labeled 145. In the illustrated embodiment, this is accomplished by the following steps:

Increment broadband gain (e.g., by 5 dB, or otherwise).

Calculate AI (element 14)

If AI>=AI from previous calculation, and E>=E tolerance, then repeat from "Increment broadband gain . . . "

Calculate AIFull_Processing (element 14)

Save AI and frequency-wise gain

COMPARE RESULT with EARLIER AIs

In the steps that follow, the result AI is compared with earlier AIs in order to determine a winner (see step 165). More particularly:

In step 150, AIFull_Processing is compared to AIMirror-plus-gain; save frequency-wise gain associated with condition that gives the higher AI In step 155, winner in previous step is compared to AINoise-to-threshold; save frequency-wise gain associated with condition that gives the higher AI In step 160, winner in previous step is compared to AIStart; save frequency-wise gain associated with condition that gives the higher AI In step 165, winner in previous step is compared to AI calculated for flat frequency response (no gain); save frequency-wise gain associated with conditions with the highest AI: This is MaxAI. It is used, as described above, to generate the enhanced intelligibility output signal 18 (see the Output element of FIG. 3).

CONCLUSION

Described above are methods and systems achieving the desired objects, among others. It will be appreciated that embodiment shown in the drawings and discussed above are examples of the invention and that other embodiments, incorporating changes to that shown here, fall within the scope of the invention. By way of non-limiting example, it will be appreciated that the invention can be used to enhance the intelligibility of single, as well as multiple, channels of speech. By way of further example, it will be appreciated that the invention includes not only dynamically generating frequency-wise gains as discussed above for real-time speech intelligibility enhancement, but also generating (or "making") such a frequency-wise gain in a first instance and applying it in one or more later instances (e.g., as where the gain is generated (or "made") during calibration for a given listening condition—such as a cocktail party, sports event, lecture, or so forth—and where that gain is reapplied later by switch actuation or otherwise, e.g., in the manner of a preprogrammed setting). By way of still further example, it will be appreciated that the invention is not limited to enhancing the intelligibility of speech and that the teachings above may also be applied in enhancing the intelligibility of music of other sounds in a communications path.

In view of the foregoing, what I claim is:

1. A method of enhancing intelligibility of speech contained in an audio signal perceived by a subject via a communications path, where the communications path includes an intelligibility enhancing device having an adjustable gain, comprising:

A. generating a candidate frequency-wise gain which, if applied to the intelligibility enhancing device, would maximize an intelligibility metric of the communications path, where the intelligibility metric is a function of the relation:

$$AI=V\times E\times F\times H$$

where,

AI is the intelligibility metric,

V is a measure of audibility of the speech contained in the audio signal and is associated with a speech-to-noise ratio in the audio signal, E is a loudness limit associated the speech contained in the audio signal, F is a measure of spectral balance of the speech contained in the audio signal, H is a measure of any of (i) intermodulation distortion introduced by an ear of the subject, (ii) reverberation in the medium, (iii) frequency-compression in the communications path, (iv) frequency-shifting in the communications path and (v) peak-clipping in the communications path, (vi) amplitude compression in the communications path, (vii) any other noise or distortion in the communications path not otherwise associated with V, E and F, and B. adjusting the gain of the intelligibility enhancing device in accord with the candidate frequency-wise gain and outputting the audio signal with the intelligibility enhancing device utilizing that adjusted gain.

2. The method of claim 1, wherein the generating step includes generating a current candidate frequency-wise gain as a function of a broadband gain adjustment of a prior candidate frequency-wise gain.

3. The method of claim 2, wherein the generating step includes performing one or more frequency-wise gain adjustments on the current candidate frequency-wise gain.

4. The method of claim 3, comprising generating a candidate frequency-wise gain that mirrors an attenuation-modeled component of an audiogram for said subject, in order to bring a sum of that candidate frequency-wise gain and that attenuation-modeled component toward zero.

5. The method of claim 4, wherein the performing step includes a noise-minimizing frequency-wise gain adjustment step comprising adjusting the current candidate frequency-wise gain to compensate for a noise spectrum associated with the communications path.

6. The method of claim 5, wherein the performing step includes a noise-minimizing frequency-wise gain adjustment step comprising adjusting the current candidate frequency-wise gain to compensate for a noise spectrum associated with the communications path, specifically, such that adjustment of the gain of the intelligibility enhancing device in accord with that candidate frequency-wise gain would bring that spectrum to audiogram thresholds.

7. The method of claim 6, wherein the performing step includes re-adjusting the current candidate frequency-wise gain to remove at least some of the adjustments made in noise-minimizing frequency-wise gain adjustment step.

8. The method of claim 7, comprising selecting as a current candidate frequency-wise gain any of a re-adjusted candidate frequency-wise gain and one or more prior candidate frequency-wise gains, where such selection is a function of which of such gains is associated with the highest intelligibility metric.

9. The method of claim 2, wherein the generating step includes generating the current candidate frequency-wise gain without substantially exceeding the loudness limit, E.

10. The method of claim 2, comprising selecting as a current candidate frequency-wise gain any of a current candidate frequency-wise gain and one or more prior candidate frequency-wise gains, where such selection is a function of which of such gains is associated with the highest intelligibility metric.

11. The method of claim 2, comprising selecting as a current candidate frequency-wise gain any of a current candidate frequency-wise gain and a zero gain, where such selection is a function of which of such gains is associated with the highest intelligibility metric.

12. The method of claim 1, comprising executing the performing step multiple times and choosing the candidate frequency-wise gain resulting from such execution associated with the highest intelligibility metric.

13. The method of claim 1, wherein the intelligibility enhancing device is any of a hearing aid, loudspeaker, assistive listening device, telephone, personal music delivery systems, public-address system, speech delivery system, speech generating system.

14. The method of claim 1, comprising generating a candidate frequency-wise gain that mirrors an attenuation-modeled component of an audiogram for said subject, in order to bring a sum of that candidate frequency-wise gain and that attenuation-modeled component toward zero.

15. A method of enhancing intelligibility of speech contained in an audio signal perceived by a subject via a communications path, where the communications path includes a intelligibility enhancing device having an adjustable gain, comprising:

A. generating a candidate frequency-wise gain that mirrors an attenuation-modeled component of an audiogram for said subject, in order to bring a sum of that candidate frequency-wise gain and that attenuation-modeled component toward zero, B. adjusting the broadband gain of the candidate frequency-wise gain so that, if applied to the intelligibility enhancing device, would maximize an intelligibility metric of the communications path without substantially exceeding a loudness limit, E, for said subject, where the intelligibility metric is a function of the relation:

$$AI=V\times E\times F\times H$$

where,

AI is the intelligibility metric,

V is a measure of audibility of the speech contained in the audio signal and is associated with a speech-to-noise ratio in the audio signal, E is a loudness limit associated the speech contained in the audio signal, F is a measure of spectral balance of the speech contained in the audio signal, H is a measure of any of (i) intermodulation distortion introduced by an ear of the subject, (ii) reverberation in the medium, (iii) frequency-compression in the communications path, (iv) frequency-shifting in the communications path and (v) peak-clipping in the communications path, (vi) amplitude compression in the communications path, (vii) any other noise or distortion in the communications path not otherwise associated with V, E and F, C. adjusting the frequency-wise gain to compensate for a noise spectrum associated with the communications path, specifically, such that adjustment of the gain of the intelligibility enhancing device in accord with that candidate frequency-wise gain would bring that spectrum to audiogram thresholds, D. adjusting the broadband gain of the candidate frequency-wise gain so that, if applied to the intelligibility enhancing device, would maximize an intelligibility metric of the communications path without substantially exceeding a loudness limit, E, for said subject, E. testing whether adjusting the candidate frequency-wise gain to remove at least some of the adjustments made in step (C) would increase the intelligibility metric of the communications path and, if so, adjusting the candidate frequency-wise gain, F. adjusting the broadband gain of the candidate frequency-wise gain so that, if applied to the intelligibility enhancing device, would maximize an intelligibility metric of the communications path without substantially exceeding a loudness limit, E, for said subject, G. choosing the candidate frequency-wise gain characteristic resulting from steps (B), (D) and (F) associated with the highest intelligibility metric, H. choosing between a zero gain and the candidate frequency-wise gain chosen in step (G), depending on which of such gains is associated with the highest intelligibility metric, and I. adjusting the gain of the intelligibility enhancing device in accord with the candidate frequency-wise gain characteristic chosen in step (H) and outputting the audio signal with the intelligibility enhancing device utilizing that adjusted gain.

16. A method of enhancing intelligibility of speech contained in an audio signal perceived by a subject via a communications path, where the communications path includes an intelligibility enhancing device, the method comprising A: applying to the intelligibility enhancing device a frequency-wise gain (hereinafter, "applied frequency-wise gain") made by a process that maximizes an intelligibility metric of the communications path, where the intelligibility metric is a function of the relation:

$$AI=V\times E\times F\times H$$

where,

AI is the intelligibility metric,

V is a measure of audibility of the speech contained in the audio signal and is associated with a speech-to-noise ratio in the audio signal, E is a loudness limit associated with the speech contained in the audio signal, F is a measure of spectral balance of the speech contained in the audio signal, H is a measure of any of (i) intermodulation distortion introduced by an ear of the subject, (ii) reverberation in the medium, (iii) frequency-compression in the communications path, (iv) frequency-shifting in the communications path and (v) peak-clipping in the communications path, (vi) amplitude compression in the communications path, (vii) any other noise or distortion in the communications path not otherwise associated with V, E and F~ and B. outputting an audio signal with the intelligibility enhancing device utilizing the frequency-wise gain applied in step (A).

17. The method of claim 16, wherein the process includes generating a current candidate frequency-wise gain as a function of a broadband gain adjustment of a prior candidate frequency-wise gain.

18. The method of claim 17, wherein the process includes performing one or more frequency-wise gain adjustments on a prior candidate frequency-wise gain.

19. The method of claim 18, wherein the process includes generating a candidate frequency-wise gain that mirrors an attenuation-modeled component of an audiogram for said subject, in order to bring a sum of that candidate frequency-wise gain and that attenuation-modeled component toward zero.

20. The method of claim 19, wherein the performing step includes a noise-minimizing frequency-wise gain adjustment step comprising adjusting the current candidate frequency-wise gain to compensate for a noise spectrum associated with the communications path.

21. The method of claim 20, wherein the performing step includes a noise-minimizing frequency-wise gain adjustment step comprising adjusting the current candidate frequency-wise gain to compensate for a noise spectrum associated with the communications path, specifically, such that adjustment of the gain of the intelligibility enhancing device in accord with that candidate frequency-wise gain would bring that spectrum to audiogram thresholds.

22. The method of claim 21, wherein the performing step includes re-adjusting the current candidate frequency-wise gain to remove at least some of the adjustments made in noise-minimizing frequency-wise gain adjustment step.

23. The method of claim 22, wherein the performing step includes selecting as a current candidate frequency-wise gain any of a re-adjusted candidate frequency-wise gain and one or more prior candidate frequency-wise gains, where such selection is a function of which of such gains is associated with the highest intelligibility metric.

24. The method of claim 18, wherein the process includes generating a current candidate frequency-wise gain without substantially exceeding the loudness limit, E.

25. The method of claim 18, wherein the process includes selecting as a current candidate frequency-wise gain any of a current candidate frequency-wise gain and one or more prior candidate frequency-wise gains, where such selection is a function of which of such gains is associated with the highest intelligibility metric.

26. The method of claim 18, wherein the process includes selecting as a current candidate frequency-wise gain any of a current candidate frequency-wise gain and a zero gain, where such selection is a function of which of such gains is associated the highest intelligibility metric.

27. The method of claim 18, wherein the process includes executing the performing step multiple times and choosing the candidate frequency-wise gain resulting from such execution associated with the highest intelligibility metric.

28. The method of claim 16, wherein the process includes generating a candidate frequency-wise gain that mirrors an attenuation-modeled component of an audiogram for said subject, such that a sum of that candidate frequency-wise gain and that attenuation-modeled component is substantially zero.

29. In a device for enhancing intelligibility of speech contained in an audio signal perceived by a subject via a communications path that includes the device, the improvement comprising:

A. the device applies to the audio signal via a gain adjustment a frequency-wise gain (hereinafter, "applied frequency-wise gain") made by a process that maximizes an intelligibility metric of the communications path, where the intelligibility metric is a function of the relation:

$$AI=V\times E\times F\times H$$

where,

AI is the intelligibility metric,

V is a measure of audibility of the speech contained in the audio signal and is associated with a speech-to-noise ratio in the audio signal, E is a loudness limit associated with the speech contained in the audio signal, F is a measure of spectral balance of the speech contained in the audio signal, H is a measure of any of (i) intermodulation distortion introduced by an ear of the subject, (ii) reverberation in the medium, (iii) frequency-compression in the communications path, (iv) frequency-shifting in the communications path and (v) peak-clipping in the communications path, (vi) amplitude compression in the communications path, (vii) any other noise or distortion in the communications path not otherwise associated with V, E and F and B. the device outputs the audio signal with the applied frequency-wise gain.

30. In the device of claim 29, the further improvement wherein the process includes generating a current candidate frequency-wise gain as a function of a broadband gain adjustment of a prior candidate frequency-wise gain.

31. In the device of claim 30, the further improvement wherein the process includes per-forming one or more frequency-wise gain adjustments on a prior candidate frequency-wise gain.

32. In the device of claim 30, the further improvement wherein the process includes generating a candidate frequency-wise gain that mirrors an attenuation-modeled component of an audiogram for said subject, in order to bring a sum of that candidate frequency-wise gain and that attenuation-modeled component toward zero.

33. In the device of claim 30, the further improvement wherein the process includes a noise-minimizing frequency-wise gain adjustment step comprising adjusting the current candidate frequency-wise gain to compensate for a noise spectrum associated with the communications path.

34. A method of enhancing intelligibility of sound contained in an audio signal perceived by a subject via a communications path, where the communications path includes a intelligibility enhancing device having an adjustable gain, comprising A. generating a candidate frequency-wise gain which, if applied to the intelligibility enhancing device, would maximize an intelligibility metric of the communications path, where the intelligibility metric is a function of the relation:

$$AI=V\times E\times F\times H$$

where,

AI is the intelligibility metric,

V is a measure of audibility of the sound contained in the audio signal and is associated with a sound-to-noise ratio in the audio signal, E is a loudness limit associated with the sound contained in the audio signal, F is a measure of spectral balance of the sound contained in the audio signal, H is a measure of any of (i) intermodulation distortion introduced by an ear of the subject, (ii) reverberation in the medium, (iii) frequency-compression in the communications path, (iv) frequency-shifting in the communications path and (v) peak-clipping in the communications path, (vi) amplitude compression in the communications path, (vii) any other noise or distortion in the communications path not otherwise associated with V, E and F, and B. adjusting the gain of the intelligibility enhancing device in accord with the candidate frequency-wise gain and outputting the audio signal with the intelligibility enhancing device utilizing that adjusted gain.

35. In a device for enhancing intelligibility of sound contained in an audio signal perceived by a subject via a communications path that includes the device, the improvement comprising:

A: the device applies to the audio signal via a gain adjustment a frequency-wise gain (hereinafter, "applied frequency-wise gain") made by a process that maximizes an intelligibility metric of the communications path, where the intelligibility metric is a function of the relation:

$$AI=V\times E\times F\times H$$

where,

AI is the intelligibility metric,

V is a measure of audibility of the sound contained in the audio signal and is associated with a sound-to-noise ratio in the audio signal, E is a loudness limit associated with the sound contained in the audio signal, F is a measure of spectral balance of the sound contained in the audio signal, H is a measure of any of (i) intermodulation distortion introduced by an ear of the subject, (ii) reverberation in the medium, (iii) frequency-compression in the communications path, (iv) frequency-shifting in the communications path and (v) peak-clipping in the communications path, (vi) amplitude compression in the communications path, (vii) any other noise or distortion in the communications path not otherwise associated with V, E and F~ and B. the device outputs the audio signal as transformed with the applied frequency-wise gain.

* * * * *